United States Patent [19]

Hunter et al.

[11] Patent Number: 4,712,847

[45] Date of Patent: Dec. 15, 1987

[54] ELECTRICAL CONNECTOR

[75] Inventors: Brook L. Hunter, Knoxville; Joseph W. Rizzie, Knox County, both of Tenn.; Marvin L. Ward, Warminster, Pa.

[73] Assignee: Technology for Energy Corporation, Knoxville, Tenn.

[21] Appl. No.: 860,455

[22] Filed: May 7, 1986

[51] Int. Cl.[4] ..... H01R 13/621; H01R 13/635

[52] U.S. Cl. ..... 439/155; 439/362; 439/277

[58] Field of Search ..... 339/94 M, 92 R, 92 M, 339/75 R, 75 M, 75 P, 103 M, 136 M, 143 R, 45 R, 45 M, 65

[56] References Cited

U.S. PATENT DOCUMENTS

| | | | |
|---|---|---|---|
| 1,152,005 | 8/1915 | Clark | 339/136 M |
| 3,406,371 | 10/1968 | Buckeridge | 339/92 M |
| 3,588,784 | 6/1971 | Kunkle et al. | 339/65 |
| 3,662,321 | 5/1972 | Bury | 339/92 M |
| 4,405,187 | 9/1983 | Muller et al. | 339/143 R |
| 4,424,407 | 1/1984 | Barbie | 339/75 P |

FOREIGN PATENT DOCUMENTS

| | | | |
|---|---|---|---|
| 690767 | 4/1953 | United Kingdom | 339/136 M |

*Primary Examiner*—John McQuade

*Attorney, Agent, or Firm*—Pitts and Brittian

[57] ABSTRACT

An improved electrical connector (10) for releasably connecting a plurality of first electrical wires with a plurality of second electrical wires. The connector (10) comprises a first connector half (12) comprising a first connector housing (14) provided with a wire cavity (16) for receiving the first electrical wires, the cavity (16) defining an elongated opening (17) and an aperture (20) for routing the first electrical wires into the cavity (16). The first connector half (12) further comprises a pin insulator (25), and a plurality of connector pins (24) mounted on the pin insulator (25). The connector (10) further comprises a second connector half (13) comprising a second connector housing (33) provided with a wire cavity (34) for receiving the second electrical wires, the cavity (34) defining an elongated opening (36) and an aperture (38) for routing the second electrical wires into cavity (34). The second connector half (13) further comprises a socket insulator (42) and a plurality of connector sockets (41) mounted on the socket insulator (42), the connector sockets (41) being positioned on the socket insulator (42) so as to register with and slidably receive the connector pins. A gasket member (64) for being secured between the first connector housing (14) and the second connector housing (33), and means for releasably locking the first connector half (12) and the second connector half (13) together are also provided.

16 Claims, 8 Drawing Figures

ELECTRICAL CONNECTOR

TECHNICAL FIELD

This invention relates to an improved electrical connector for selectively connecting a plurality of electrical wires. More specifically the present invention comprises a pair of connector halves which can be releasably coupled to accomplish a hermetically sealed electrical connection.

BACKGROUND ART

In the nuclear industry it is often necessary to accomplish hermetically sealed electrical connections in extremely harsh environments characterized by high radiation levels, steam saturated air, and temperature and pressure extremes. In such harsh environments conventional electrical connectors often prove unsuitable. Even those connectors which accomplish a hermetically sealed connection often are unable to withstand the temperature and pressure extremes, or the effects of high radiation levels. Further, those connectors which have been devised to withstand the rigors of such harsh environments tend to be complex, bulky devices which are difficult to install and maintain.

Therefore, it is an object of the present invention to provide an improved electrical connector for releasably connecting a plurality of electrical wires.

It is another object of the present invention to provide an improved electrical connector which can maintain a hermetically sealed electrical connection in an environment characterized by high radiation levels, steam saturated air, and temperature and pressure extremes.

A further object of the present invention is to provide an improved electrical connector comprising a pair of connector halves, and locking means for releasably locking the connector halves together to avoid inadvertent disconnection.

It is yet another object of the present invention to provide an improved electrical connector with a streamline design, allowing such connector to be inserted through small apertures.

Still a further object of the present invention is to provide an electrical connector which is inexpensive to manufacture and maintain.

DISCLOSURE OF THE INVENTION

Other objects and advantages will be accomplished by the present invention which provides an improved electrical connector for releasably connecting a plurality of first electrical wires with a plurality of second electrical wires. The improved electrical connector of the present invention includes a first connector half comprising a first connector housing provided with a wire cavity for receiving the first electrical wires, the wire cavity defining an elongated opening and an aperture for routing the first electrical wires into the wire cavity. The first connector half further comprises a connector pin insulator defining inner and outer surfaces, and a plurality of connector pins mounted on the pin insulator. The pin insulator is secured to the first housing such that the elongated opening of the first connector housing communicates with at least a selected portion of the lower surface of the pin insulator, whereby access is provided for selectively securing the first electrical wires to the connector pins. The improved connector of the present invention also includes a second connector half comprising a second connector housing provided with a wire cavity for receiving the second electrical wires, the wire cavity defining an elongated opening and an aperture for routing the second electrical wires into the wire cavity. The second connector half further comprises a socket insulator defining inner and outer surfaces, and a plurality of connector sockets mounted on the socket insulator. The connector sockets are positioned on the socket insulator so as to register with and slidably receive the connector pins, the socket insulator being secured to the second housing such that the elongated opening of the second connector housing communicates with at least a selected portion of the lower surface of the socket insulator whereby access is provided for selectively securing the second electrical wires to the connector sockets. A gasket member is provided for being secured between the first connector housing and the second connector housing for accomplishing a substantially fluid impervious seal circumscribing the elongated openings of the first and second housings. Further, means are provided for releasably locking the first connector half and the second connector half together as the connector pins are received in the connector sockets.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
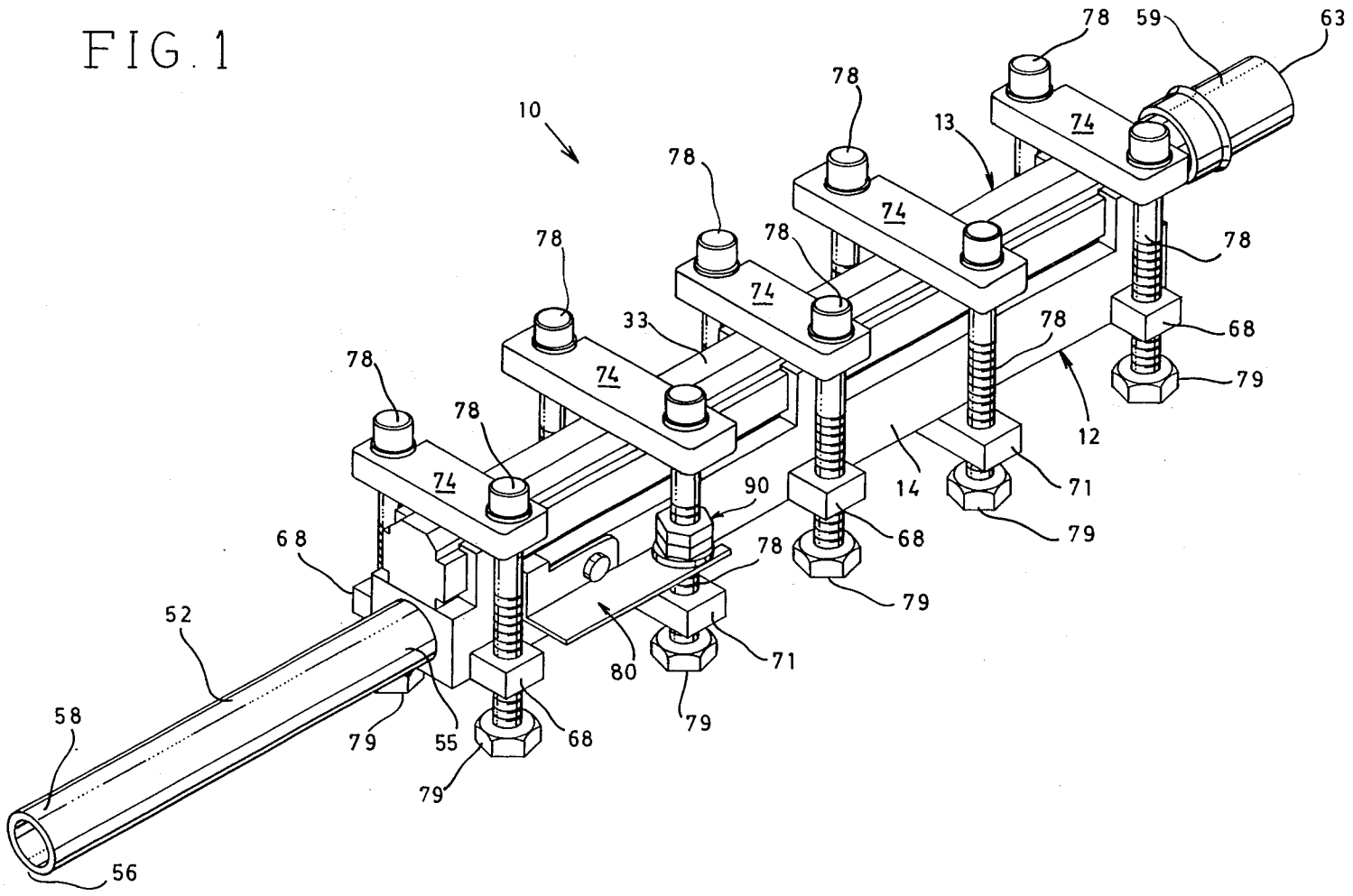
FIG. 1 illustrates a perspective view of an improved electrical connector of the present invention.
Figure 2:
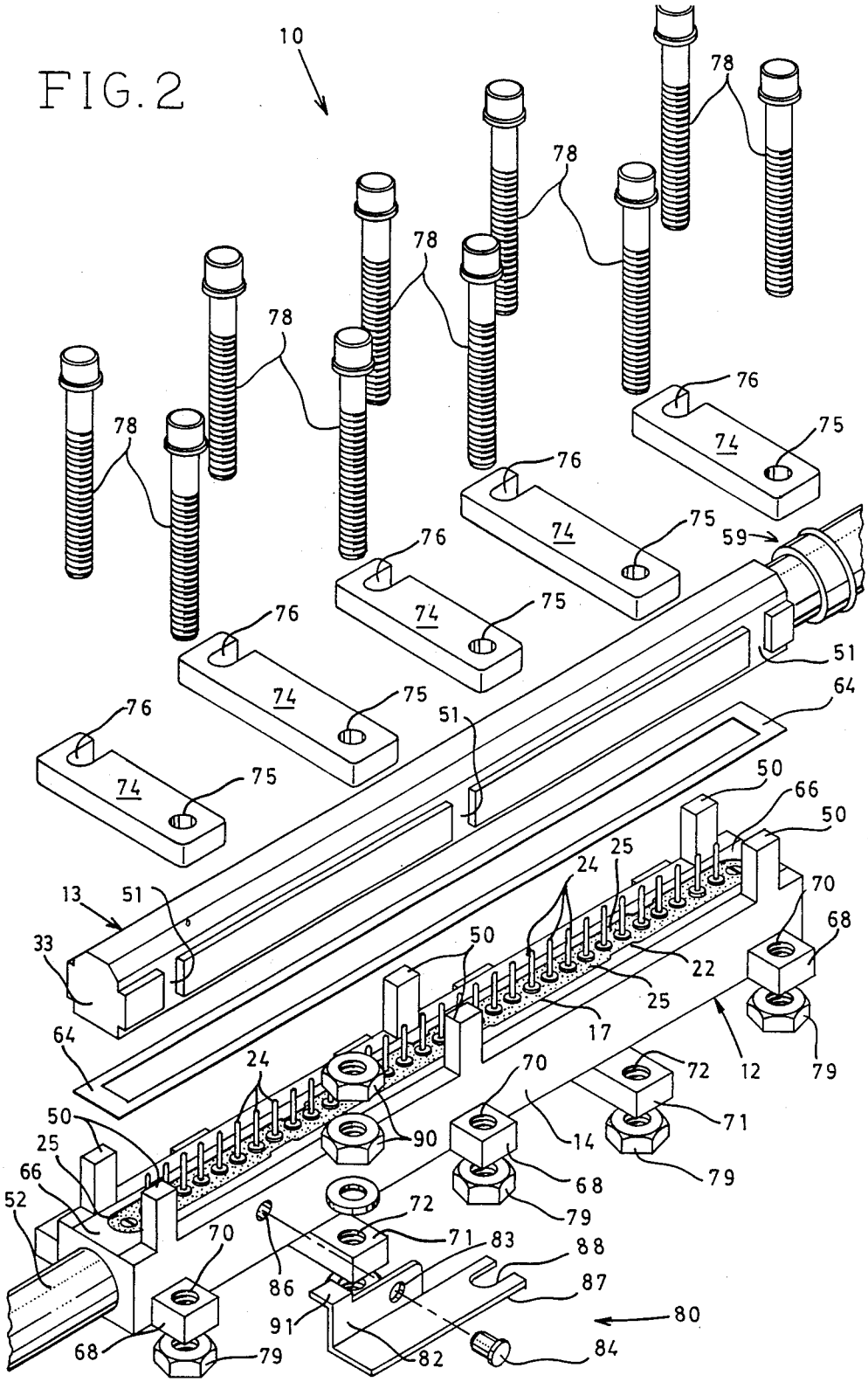
FIG. 2 illustrates an exploded perspective view of an improved electrical connector of the present invention.

An improved electrical connector incorporating various features of the present invention is illustrated generally at 10 in the Figures. The connector 10 is designed particularly for use by the nuclear industry to accomplish hermetically sealed, releasable electrical connections in harsh environments characterized by pressure and temperature extremes, radiation, and steam saturated air. For example, the connector 10 can be used to electrically connect a field cable to a multi-lead instrument such as a gamma thermometer. This application requires that the electrical connection be made and maintained at a location exterior to the nuclear reactor core vessel, but within the shield walls of the reactor containment vessel in an environment characterized by radiation in excess of 100 Mega Rads, temperatures in excess of 380 degrees F. and pressure in excess of 65 PSI.

The improved connector 10 generally comprises first and second connector halves 12 and 13, respectively, which releasably engage one another to accomplish a hermetically sealed electrical connection. As illustrated in the figures, the first connector half 12 comprises a first connector housing 14 which is provided with a wire cavity 16, the cavity 16 defining an elongated opening 17 which is circumscribed by a recessed rim portion 18. An aperture 20 is also provided in the housing 14 through which the wires 21 to be releasably connected are received and routed into the cavity 16. Further, in the preferred embodiment of the connector 10, the housing 14 is provided with a plurality of selectively positioned retaining tabs 22 which protrude from the side walls of the recessed rim portion 18, the purpose of which will be discussed below. In the preferred embodiment of the connector 10, the housing 14 is fabricated of stainless steel or other durable, corrosion resistant metal.

Figure 4A:
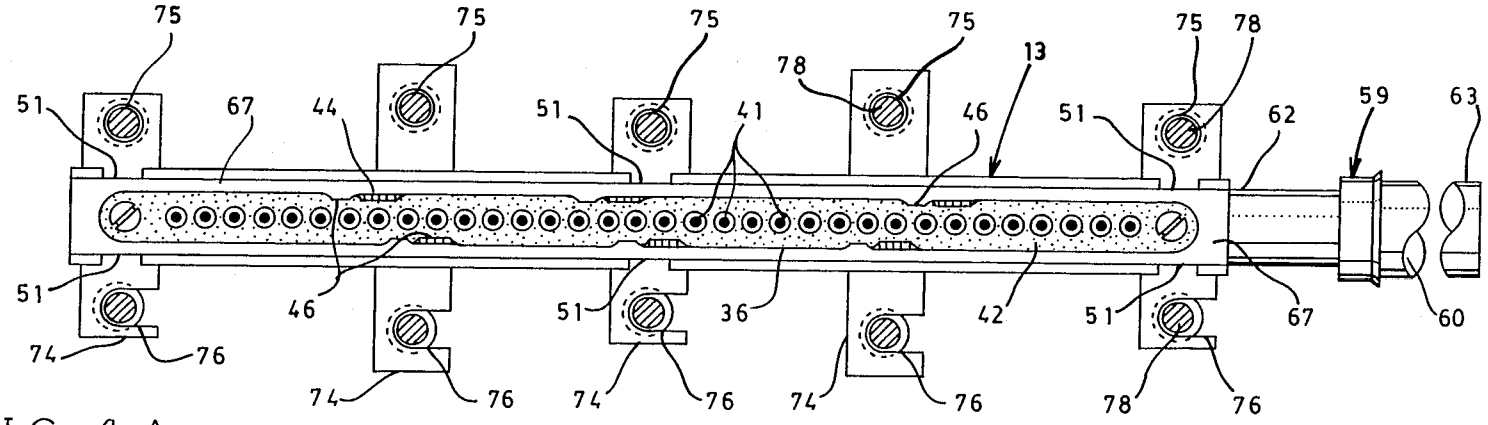
FIG. 4A is a top view of the first connector half of an improved electrical connector of the present invention.
Figure 4B:
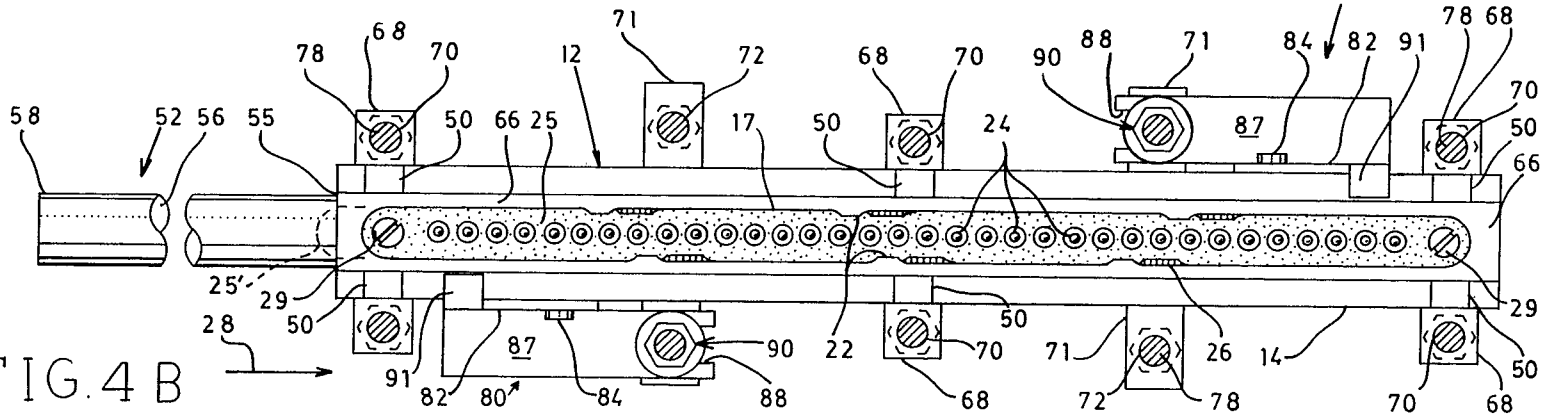
FIG. 4B is a top view of the second connector half of an improved electrical connector of the present invention.

The first connector half 12 further comprises a plurality of connector pins 24 mounted on a connector pin insulator 25. As illustrated, the connector pin insulator 25 is closely received and supported in the recessed rim portion 18 of the first housing 14. With regard to the manner in which the insulator 25 is inserted and secured in the recessed rim portion 18 in the preferred embodiment, the insulator 25 is provided with cutaway portions 26 which can be aligned so as to register with the tab members 22 of the housing 14 when the insulator 25 is selectively positioned as indicated by the broken lines at 25' in FIG. 4B. With the insulator 25 thusly positioned, the insulator can be pressed into the recessed rim portion 18 and moved in the direction of the arrow 28 to the desired position within the recessed rim portion 18 such that the cutaway portions 26 no longer registering with the tab members 22 and the edges of the insulator 25 are held in position by the tab members 22. To further insure that the insulator 25 is properly secured within the recessed rim portion 18, the insulator 25 is provided at its opposite end portions with suitable fastening means such as the screws 29 which are received through the holes 30 in the insulator 25 and threadably received in the holes 32 in the housing 14. Of course, the means for properly positioning and securing the insulator 25 within the recessed rim portion 18 disclosed above illustrates only one preferred means for securing the insulator 25, and various other suitable securing means can be employed if desired.

As illustrated in the Figures, the connector pins 24 are mounted on the connector pin insulator 25 such that they extend outwardly from the exterior surface of the insulator 25. With the connector pins thusly mounted, the wires 21 (only a representative few being shown), which are routed into the wire cavity 16 through the aperture 20, are each secured to a connector pin 24 in the desired sequence. It will be appreciated that various types and/or sizes of connector pins can be used with the connector half 14, and the illustrated connector pins 24 are merely illustrative of one preferred connector pin. Further, the number of connector pins 24 mounted on the insulator 25 can vary depending upon the number of wires 21 which must be electrically connected.

The second connector half 13 of the connector 10 comprises a second connector housing 33 which is provided with a wire cavity 34 defining an elongated opening 36 circumscribed by a recessed rim portion 37. An aperture 38 is also provided in the housing 33 for routing the wires 40 to be electrically connected into the cavity 34. In the preferred embodiment of the connector 10, the housing 33 is fabricated of stainless steel or other durable, corrosion resistant metal as was the case with the housing 14. The second connector half 13 also comprises a plurality of connector sockets 41 mounted on a connector socket insulator 42. As will be discussed further below, each connector socket 41 releasably receives an operatively associated connector pin 24, and, thus, the size and type of connector socket will vary with the type of connector pin 24 which is used. The insulator 42 is closely received in the recessed rim portion 37 and is secured in the manner described above with regard to the securing of the insulator 25 in the recessed portion 18 of housing 14. In this regard, in the preferred embodiment the insulator 42 is provided with cutaway portions 44, and the housing 33 is provided with the retaining tabs 46, the cutaway portions 44 and the tabs 46 corresponding in function to the cutaway portions 26 and the retaining tabs 22 described above. Further, the opposite end portions of the insulator 42 are secured to the housing 33 with suitable fasteners such as the screws 29 which are received through the holes 47 in the insulator 42 and threadably secured in the holes 48 in the housing 33.

Figure 3:
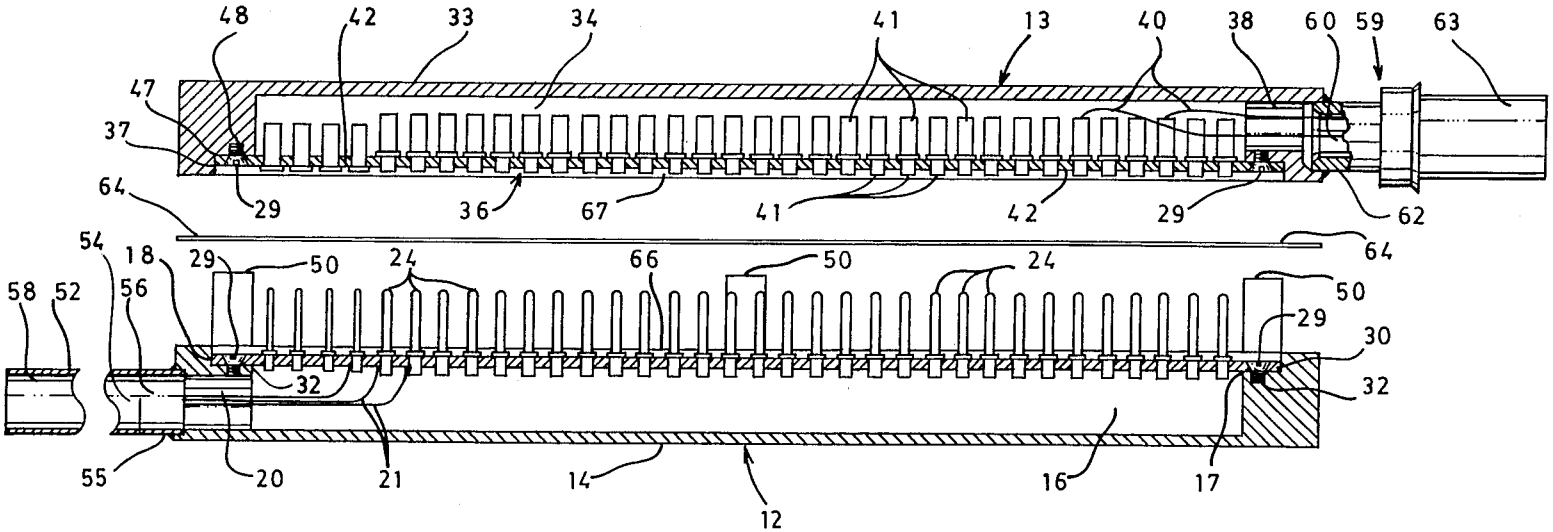
FIG. 3 illustrates an exploded side elevation view, in section, of an improved electrical connector of the present invention.
Figure 5:
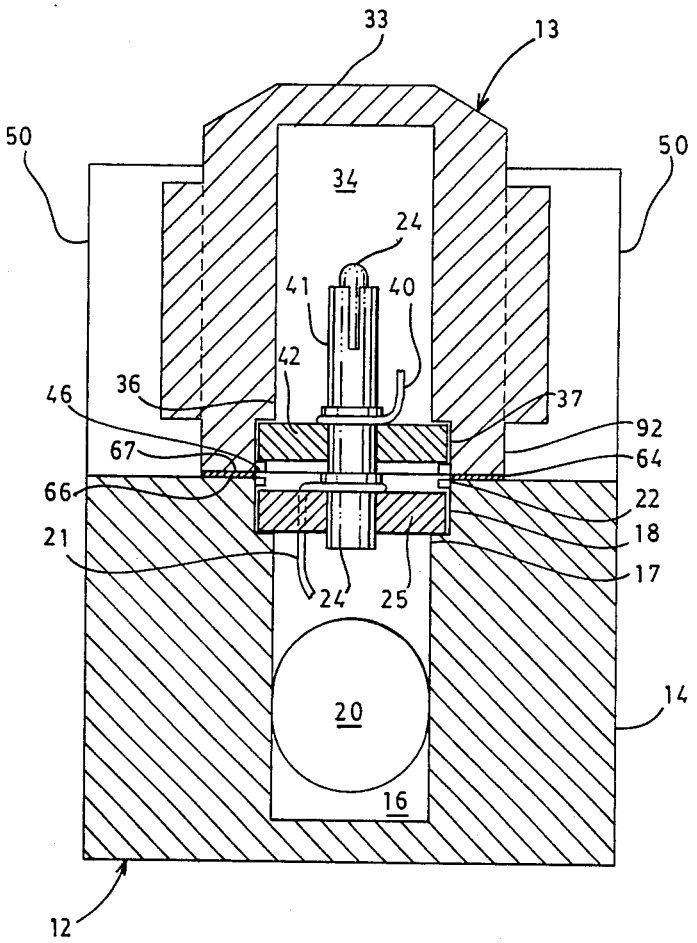
FIG. 5 is an end view, in section, of the first and second connector halves of an improved electrical connector of the present invention.
Figure 6:
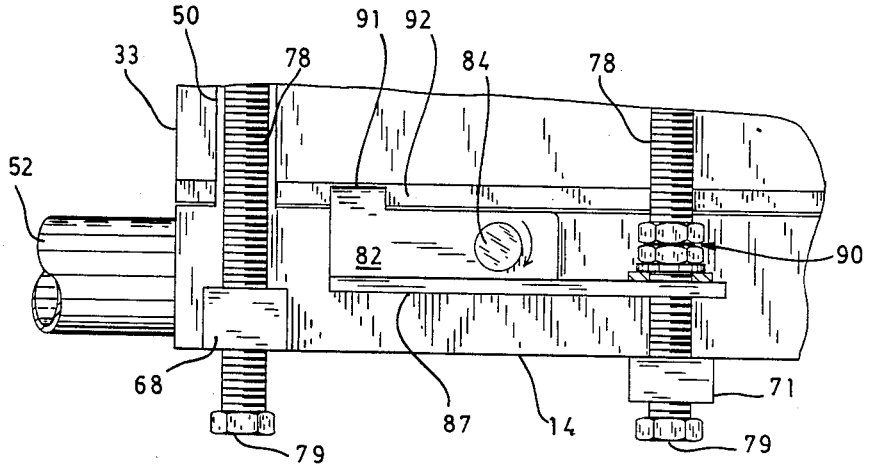
FIG. 6 is a side elevation view of a jack member of the present invention as it is pivotally mounted on the first connector housing prior to use of the jack member to separate the connector halves.

As is illustrated in FIG. 3, the wires 40 are routed into the cavity 34 through the aperture 38 and are conductively secured to the connector sockets 41 in the desired sequence. It will be appreciated that the connector sockets 41 are oriented on the insulator 42 such that when the connector halves 12 and 13 are brought together, the sockets 41 register with and releasably rreceive the connector pins 24 so as to electrically connect the operatively associated wires 40 and 21 as illustrated in FIG. 5. To facilitate the alignment of the connector halves 12 and 13 such that they can be properly joined, and to stabilize the position of the connector half 13 with respect to the connector half 12 after the connector halves have been joined, the housing 14 is provided with the brace members 50 which are slidably received in the alignment slots 51 defined in the housing 33. Of course, it will be understood that the brace members 50 and the alignment slots 51 are positioned such that when the brace members 50 are aligned to be received in the slots 51, the connector pins 24 are aligned to be received in the sockets 41 as well. Further, once the connector halves 12 and 13 are joined, the housing 33 is essentially journalled between the brace members 50, and lateral movement of the housing 33 is substantially eliminated.

It is contemplated that certain applications will require that the connector halves 12 and/or 13 be mounted on the end of an electrical cable carrying the wires to be connected, and other applications will require that the connector halves be mounted directly on an instrument or device which is to be electrically connected. For applications where one, or both, of the connector halves 12 and 13 must be mounted on a cable end, the preferred embodiment of the connector 10 is provided with one or more cable tubes 52. In the figures the cable tube 52 is illustrated as being mounted on the connector half 12; however, it will be appreciated that when required, either or both of the connector halves can be provided with a cable tube. The cable tube 52 comprises a cylindrical sleeve defining an annular passageway therethrough for closely receiving an electrical cable 54. The first end portion 55 of the tube 52 is secured (as by welding) to the housing 14 such that the passageway 56 communicates with the aperture 20, while the outboard end portion end portion 58 of the tube 52 defines an opening for closely receiving the electrical cable 54. It will be appreciated by those skilled in the art that the cable tube 52 supports the connector half 12 as it is mounted on the cable end so as to reduce the likelihood that the wires 21 carried by the cable 54 will be severed or inadvertently pulled from its operatively associated connector pin 24.

Similarly, where the application requires that one or both of the connector halves 12 and 13 be mounted directly on the instrument to be electrically connected, one or more of the connector adapters 59 is provided. In the figures the adapter 59 is illustrated as being mounted on the connector half 13, but it will be appreciated that the adapter 59 can be mounted on either or both of the connector halves as desired. The adapter 59 defines a passageway 60 therethrough for receiving the wires 40 from the instrument to be electrically connected and is secured (as by welding) at its first end portion 62 to the housing 33 such that the passageway 60 communicates with the aperture 38. It will be appreciated that the outboard end portion 63 of the adapter 59 is secured to the instrument to be electrically connected and, therefore, will vary in configuration depending on the instrument to which it is to be connected. Thus, it will be understood that the use of variously configured adapters 59 allows the connector 10 to be used with various instruments and devices without modification to the housings 14 and 33 or other components of the connector 10.

In order to insure that a hermetically sealed coupling is accomplished, the connector 10 further comprises a gasket member 64 for being positioned between the connector halves 12 and 13, and is provided with locking means for releasably securing the connector halves 12 and 13 together. More specifically, the gasket member 64 borders the recessed rim portions 18 and 37, and is positioned between the engaged surface 66 of the housing 14 and the engaging surface 67 of the housing 33. In the preferred embodiment of the connector 10, the gasket member 64 is fabricated of silicone. It will be appreciated by those skilled in the art that high radiation levels tend to break down conventional gasket fabricating material. However, the silicone gasket 64 is substantially unaffected by radiation and is sufficiently malleable to assume the geometry of the engaging surfaces 66 and 67 so as to effect the desired seal. Further, in the preferred embodiment of the connector 10, the engaging surfaces 66 and 67 define highly polished surfaces thereby facilitating the effectuation of the desired seal.

With respect to the locking means for releasably securing the connector halves 12 and 13 together, the housing 14 is provided with a plurality of lug members 68 aligned in oppositely disposed pairs selectively spaced on either side of the housing 14, each of the lug members 68 defining a threaded receptor 70. Further, in the preferred embodiment, the cross braces 71 are secured to the bottom of the housing 14 (as by welding), the braces 71 defining opposite end portions provided with the threaded receptors 72.

Operatively associated with each pair of lug members 68 and each cross brace 71 is a swing away clamp 74. Each of the clamps 74 defines a first end portion provided with a hole 75 and a second end portion provided with a slot 76. The holes 75 and the slots 76 are oriented such that they register with the operatively associated threaded receptors 70 and 72. Accordingly, the bolts 78 are received through the holes 75 and the slots 76 and threadably received in the operatively associated threaded receptor 70 or 72. In the preferred embodiment of the connector 10, the bolts 78 are threaded through the threaded receptors 70 and 72, and the nuts 79 are permanently secured to the outboard end portions of the bolts 78. The securing of the nuts 70 to the outboard end portions of the bolts 78 insures that all components of the locking means are secured to the connector half 12 and will not become separated or lost. Of course, the use of the swing away clamps 74 facilitates this construction by obviating any need to totally remove the bolts 8 from the threaded receptors 70 and 72. Thus, it will be understood that in order to secure the connector halves 12 and 13 together, the gasket member 64 is first placed in position on the engaging surface 66 and the housing 33 is coupled with the housing 14 as described above. The swing away clamps 74 are then pivoted into position such that the slots 76 receive the bolts 78 and the bolts 78 are threaded into the receptors 70 and 72, thus forcing the connector halves 12 and 13 together.

It will be appreciated by those skilled in the art that after the connector halves 12 and 13 have been joined with sufficient torque applied to the bolts 78 to effect a hermetically sealed connection, difficulty may be encountered in separating the connector halves 12 and 13 when disconnection is desired. Therefore, to aid in the separation of the connector halves 12 and 13, the connector is provided with a pair of jack members 80. One jack member is provided on each side of the housing 14 at opposite ends from each other. As illustrated in the Figures, each of the jack members 80 comprises a mounting plate 82 provided with a hole 83 for pivotally receiving the pivot pin 84. The pivot pin 84 is, in turn, force-fitted into a receptor 86 provided in the housing 14, thereby pivotally securing the jack member 80 to the housing 14. Each jack member 80 further comprises a lever portion 87 which extends substantially perpendicular to, and outwardly from, the mounting plate 82 and is provided at its outboard end portion with a slot 88 for slidably receiving the adjacent bolt 78, with a double nut stop assembly 90 being threadably provided on such bolt 78. Still further, each jack member 80 defines a flange member 91 which is slidably received in the slot 92 defined by the joined housings 14 and 33.

Figure 7:
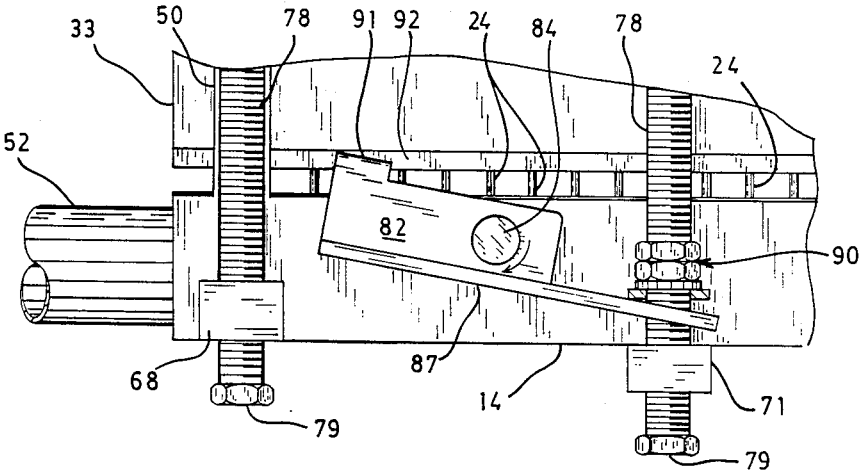
FIG. 7 is a side elevation view of a jack member of the present invention as it is pivotally mounted on the first connector housing after use of the jack member to separate the connector halves.

Thus, in order to separate the connector halves 12 and 13, the bolts 78 are first loosened such that the clamps 74 can be disengaged. The bolt 78 which is associated with the jack member 80 is then threaded into the associated threaded receptor 72 causing the stop assembly 90, and the outboard end portion of the lever portion 87, to move toward the cross brace 71. Resultantly, as illustrated in FIG. 7, the jack member 80 is pivoted such that the flange member 91 engages the connector half 13 and forces the connector half 13 to disengage from the connector half 12.

In view of the above, it will be appreciated that the connector 10 provides an improved connector for releasably connecting a plurality of electrical wires. The connector halves 12 and 13 of the connector 10 can be hermetically sealed to maintain the desired electrical connections even in the harshest of environments. In this regard, the silicone gasket member 64 allows a fluid impervious seal to be maintained in the presence of high radiation levels and high temperatures, and the stainless steel housings 14 and 33 resist corrosion even in a steam filled nuclear containment vessel. It will also be appreciated that the alignment of the connector pins 24 and the operatively associated sockets 41 in single columns results in a streamlined design which allows the connector 10 to be mounted in confined spaces and inserted through narrow apertures. This is particularly true of the connector half 13. With the associated connector pins, bracing members, and locking means being carried by the connector half 12, the connector half 13 defines a narrow elongated housing capable of being inserted through narrow apertures. Still further, all components of the locking means for securing the connector halves 12 and 13 together are secured to the housing 14 such that such components are not separated from the connector and lost in an environment where retrieval would be difficult, expensive and time consuming.

While a preferred embodiment has been shown and described, it will be understood that there is no intent to limit the invention to such disclosure, but rather it is intended to cover all modifications and alternate constructions falling within the spirit and scope of the invention as defined in the appended claims.

What is claimed is:

1. An improved electrical connector for releasably connecting a first plurality of electrical wires with a second plurality of electrical wires, which comprises:

a first connector half having a. a first elongated housing having two end walls, two oppositely disposed side walls, and a bottom wall to define a first elongated wire cavity for receiving said first plurality of electrical wires, said first cavity defining a first elongated opening, said first housing having an aperture in one of said end walls for routing said first plurality of electrical wires into said first cavity, b. a first plurality of lug members extending outwardly from one of said side walls of said first housing, and a second plurality of lug members extending outwardly from the other of said side walls oppositely disposed from said first plurality of lug members, each of said lug members provided with a threaded receptor, c. a pin insulator, defining inner and outer surfaces, mounted in said first opening whereby at least a selected portion of said inner surface of said pin insulator is accessible from said first cavity, and d. a plurality of connector pins mounted through said pin insulator in a selected pattern whereby ends of said first plurality of electrical wires can be secured to ends of said pins within said first cavity;

a second connector half having a. a second elongated housing having two end walls, two oppositely disposed side walls, and a bottom wall to define a second elongated wire cavity for receiving said second plurality of electrical wires, said second cavity defining a second elongated opening, said second housing having an aperture in one of said end walls, oppositely disposed from said aperture in said first housing, for routing said second plurality of electrical wires into said second cavity, b. a socket insulator, defining inner and outer surfaces, mounted in said second opening whereby at least a selected portion of said inner surface of said socket insulator is accessible from said second cavity, and c. a plurality of connector sockets mounted through said socket insulator in a pattern complementary of said selected pattern of said connector pins whereby ends of said second plurality of electrical wires can be secured to ends of said connector sockets within said second cavity;

a gasket member for being secured between said first connector housing and said second connector housing; and locking means for releasably locking together said first and second connector halves with said connector pins being received in said connector sockets, said locking means having a. a plurality of swing away clamp members equal in number to lug members of said first plurality of lug members, each of said clamp members provided with a hole therethrough proximate one end thereof and with an edge slot proximate a second end, said clamp members for engagement with said bottom wall of said second elongated housing, b. a first plurality of bolt members each received through one of said holes in said clamp members and threadably received in said threaded receptors of said first plurality of lug members, and a second plurality of bolt members threadably received in said threaded receptors of said second plurality of lug members, each of said second plurality of bolt members releasably receiving in one of said slots of said clamp members whereby threading said first and second plurality of bolts into said threaded receptors of said lug members causes said first and second connector halves to be drawn together for engagement of said connector pins with said connector sockets and compression of said gasket between said connector halves.

2. The improved electrical connector of claim 1 wherein said elongated opening of said first connector housing defines a recessed rim portion circumscribing said elongated opening of said first connector housing for closely receiving and supporting said pin insulator, and wherein said elongated opening of said second connector housing defines a recessed rim portion circumscribing said elongated opening of said second connector housing for closely receiving and supporting said socket insulator.

3. The improved electrical connector of claim 1 wherein said gasket member is fabricated substantially of silicone.

4. The improved electrical connector of claim 1 wherein said first and second connector housings are fabricated of stainless steel.

5. The improved electrical connector of claim 1 wherein said first connector housing is provided with a plurality of outwardly extending brace members disposed on both sides of said elongated opening of said first connector housing, and said second connector housing is provided with opposite side portions defining slots for slidably receiving said brace members of said first connector housing, whereby said second connector housing is journalled between said brace members as said first and second connector halves are releasably coupled together.

6. The improved electrical connector of claim 1 wherein said locking means for releasably locking said first and second connector halves together further comprises:

at least one cross brace attached to said bottom wall of said first housing, said cross brace defining first and second opposite end portions each provided with a threaded receptor;

further swing clamp members equal in number to said cross braces, each further swing clamp members provided with a hole proximate one end thereof and with an edge slot proximate a second end;

a first further bolt member received through said hole in said further clamp member and threadably received in said threaded receptor of one end of said cross brace, and a second further bolt member threadably received in said threaded receptor of a second end of said cross brace, said second further bolt member releasably received in said slot of said cross brace, whereby threading said first and second further bolt members into said receptors of said cross brace causes said first and second connector halves to be drawn together.

7. The electrical connector of claim 6 further including at least one jack member for selectively separating said first connector half from said second connector half, said at least one jack member comprising:

a mounting plate pivotally mounted to one of said side walls of said first housing with a pivot member, said mounting plate having a first and a further end;

a flange member carried on said first end of said mounting plate, said flange member disposed between said first and second connector housings proximate said gasket member so as to bear against said second connector housing when said at least one jack member is operated to separate said halves;

a lever member carried on said further end of said mounting plate, said lever member provided at an outer end with a forked slot to embrace one of said further bolt members threadably received in said cross brace; and stop means carried on said further bolt member embraced by said lever member whereby rotation of said further bolt member embraced by said lever member causes said stop means to move said lever means and thereby pivot said mounting plate whereby said flange member causes said connector housing halves to be separated.

8. The electrical connector of claim 1 wherein at least one of said first and second elongated housings has a transverse dimension sufficiently small to pass through a small aperture prior to being coupled to the other of said first and second elongated housings, and wherein said gasket member is fabricated of silicone.

9. The electrical connector of claim 7 wherein two jack members are provided for selectively separating said first connector half from said second connector half, one of said jack members positioned on one of said side walls of said first housing proximate one of said end walls and a second of said jack members positioned on a second of said side walls of said first housing proximate an opposite end wall.

10. The improved electrical connector of claim 1 wherein each bolt member of said first and second plurality of bolt members defines an outboard end portion extending through said receptors of said lug members, and each bolt member of said first and second plurality of bolt members is provided with a nut fixedly secured proximate said outboard end portion whereby said means for releasably locking said first and second connector halves is secured to said first connector housing.

11. The improved electrical connector of claim 6 wherein each said bolt member operatively associated with said cross brace defines an outboard end portion extending through said receptors of said cross brace, and a nut is secured proximate each said outboard end portion whereby said means for releasably locking said first and second connector halves together is secured to said first connector housing.

12. An improved electrical connector for releasably connecting a plurality of first electrical wires with a plurality of second electrical wires, said connector comprising:

a first connector half comprising a first connector housing defining first and second opposite side portions and a bottom portion, said first connector housing being provided with a wire cavity for receiving said first electrical wires, said wiring cavity defining an elongated opening and defining an aperture for routing said first electrical wires into said wire cavity, said first connector housing further comprising a plurality of first lug members extending outwardly from said first said portion of said first housing and a plurality of second lug members, oppositely disposed with respect to said first lug members, extending outwardly from said second side portion of said first connector housing, each said first and second lug member being provided with a threaded receptor; said first connector half further comprising a pin insulator defining inner and outer surfaces, and a plurality of connector pins mounted on said pin insulator, said pin insulator being secured to said first housing such that said elongated opening of said first connector housing communicates with at least a selected portion of said inner surface of said pin insulator whereby access is provided for selectively securing said first electrical wires to said connector pins, said first connector housing further comprising a plurality of outwardly extending brace members disposed on both sides of said elongated opening;

a second connector half comprising a second connector housing defining first and second opposite side portions and a top portion, said second connector housing being provided with a wire cavity for receiving said second electrical wires, said wiring cavity of said second connector housing defining an elongated opening and defining an aperture for routing said second electrical wires into said wire cavity, said second connector half further comprising a socket insulator defining inner and outer surfaces, and a plurality of connector sockets mounted on said socket insulator, said connector sockets being positioned on said socket insulator so as to register with and slidably receive said connector pins, said socket insulator being secured to said second housing such that said elongated opening of said secnd connector housing communicates with at least a selected portion of said inner surface of said socket insulator whereby access is provided for selectively securing said second electrical wires to said connector sockets, said second connector housing defining a plurality of slots defined in said first and second opposite side portions for slidably receiving said brace members of said first connector housing, whereby said secnd connector housing is journalled between said brace members as said first and second connector halves are releasably coupled together;

a silicone gasket member for being secured between said first connector housing and said second connector housing for accomplishing a substantially fluid impervious seal circumscribing said elongated openings of said first and second housings; and means for releasably locking said first connector half and said second connector half together as said connector pins are received in said connector sockets, said means comprising a swing away clamp member for each said first lug member, each said clamp member comprising a first end portion provided with a hole therethrough and a second end portion defining a slot, said means for releasably locking said first and second connector halves further comprising a first bolt member for each said first lug member, each said first bolt member defining a shank portion for being received through said hole in one said clamp member and threadably received in said threaded receptor of one said first lug member, and comprising a second bolt member for each said second lug member, each said second bolt member defining a shank portion for being releasably received in said slot of one said claim member and threadably secured in said threaded receptor of one said second lug member.

13. The improved electrical connector of claim 12 wherein said elongated opening of said first connector housing defines a recessed rim portion circumscribing said elongated opening of said first connector housing for closely receiving and supporting said pin insulator, and wherein said elongated opening of said second connector housing defines a recessed rim portion circumscribing said elongated opening of said second connector housing for closely receiving and supporting said socket insulator.

14. The improved electrical connector of claim 12 wherein said means for releasably locking said first and second connector halves further comprises at least one cross brace defining first and second opposite end portions provided with threaded receptors, each said cross brace being provided with a further swing away clamp member, said further clamp member having a first end portion provided with a hole and a second end portion provided with a slot, and with a pair of further bolt members each having a shank portion whereby said shank portion of one of said further bolt members is received through said hole in said further clamp member and threadably received in said threaded receptor of said first end portion of said cross brace and said shank portion of a second of said further bolt members is releasably received in said slot in said second end portion of said further clamp member and threadably received in said threaded receptor of said second end portion of said cross brace.

15. The improved electrical connector of claim 12 wherein each said first and second bolt member defines an outboard end portion, and each said first and second bolt member is provided with a nut fixedly secured proximate said outboard end portion whereby said means for releasably locking said first and second connector halves is secured to said first connector housing.

16. The improved electrical connector of claim 12 wherein said first connector housing is provided with a pivot pin receptor in said first side portion, and wherein said connector is further provided with at least one jack member comprising a mounting plate pivotally secured to said first side portion of said first housing with a pivot pin received in said pivot pin receptor, said mounting plate having a first end portion provided with a flange member for selectively engaging said second connector housing, said at least one jack member further comprising a lever portion at a second end portion of said mounting plate, said lever portion having an outboard end portion provided with a slot for slidably receiving one said first bolt member received in said slot of said lever portion operatively associated therewith, said bolt member received in said slot of said lever portion being provided with a stop assembly for selectively engaging said outboard end portion of said lever portion, whereby the selective threading of said bolt member causes said stop assembly to engage said outboard end portion of said lever portion and pivot said at least one jack member at said pivot pin such that said flange member engages said second connector housing and separates said first and second connector housings.

* * * * *

UNITED STATES PATENT AND TRADEMARK OFFICE

CERTIFICATE OF CORRECTION

PATENT NO. : 4,712,847

DATED : December 15, 1987

INVENTOR(S) : Brook L. Hunter, Joseph W. Rizzie and Marvin L. Ward

It is certified that error appears in the above-identified patent and that said Letters Patent is hereby corrected as shown below:

At Column 4, lines 37-38, "rreceive" should read --receive--.

At Column 5, line 6, "end portion end portion" should read --end portion--.

Signed and Sealed this

Fourteenth Day of March, 1989

*Attest:*

*Attesting Officer*

DONALD J. QUIGG

*Commissioner of Patents and Trademarks*